United States Patent [19]

Matsuda et al.

[11] 3,975,242

[45] Aug. 17, 1976

[54] HORIZONTAL RECTILINEAR TYPE METAL-ELECTROPLATING METHOD

[75] Inventors: Shozo Matsuda, Tokyo; Tadashi Tanaka, Yokohama; Joji Oka, Kawasaki; Saburo Ayusawa; Kiyotoshi Iwasaki, both of Kisarazu; Toshiyuki Teramachi; Toshitake Miyazono, both of Kimitsu, all of Japan

[73] Assignee: Nippon Steel Corporation, Tokyo, Japan

[22] Filed: Dec. 16, 1974

[21] Appl. No.: 533,089

Related U.S. Application Data

[63] Continuation of Ser. No. 310,079, Nov. 28, 1972, abandoned.

[52] U.S. Cl. ..... 208/28; 204/206

[51] Int. Cl.[2] ..... C25D 7/00; C25D 7/06

[58] Field of Search ..... 204/28, 206, DIG. 7, 204/207–211

[56] References Cited

UNITED STATES PATENTS

| | | | |
|---|---|---|---|
| 2,080,506 | 5/1937 | Rinck et al. | 204/28 |
| 2,370,973 | 3/1945 | Lang | 204/28 |
| 2,399,964 | 5/1946 | Ward | 204/28 |
| 2,461,556 | 2/1949 | Lorig | 204/28 |
| 2,909,474 | 10/1959 | Smith | 204/206 |
| 3,616,426 | 10/1971 | Nakao | 204/207 |

FOREIGN PATENTS OR APPLICATIONS

| | | | |
|---|---|---|---|
| 749,333 | 12/1966 | Canada | 204/206 |

*Primary Examiner*—T. M. Tufariello

*Attorney, Agent, or Firm*—Wenderoth, Lind & Ponack

[57] ABSTRACT

A method for electroplating a metal strip to be plated includes continuously running the metal strip through the interior of a plating vessel of a cylindrical form having a rectangular cross section, the upper and lower walls of such vessel being constructed of an insoluble anode material which is to function as an anode, and compulsively circulating a plating solution in a direction counter to the running direction of the metal strip within the plating vessel and an apparatus for carrying out the same, whereby a high speed plating is performed and the replacement of the anodes can be minimized.

3 Claims, 7 Drawing Figures

FIG. 1
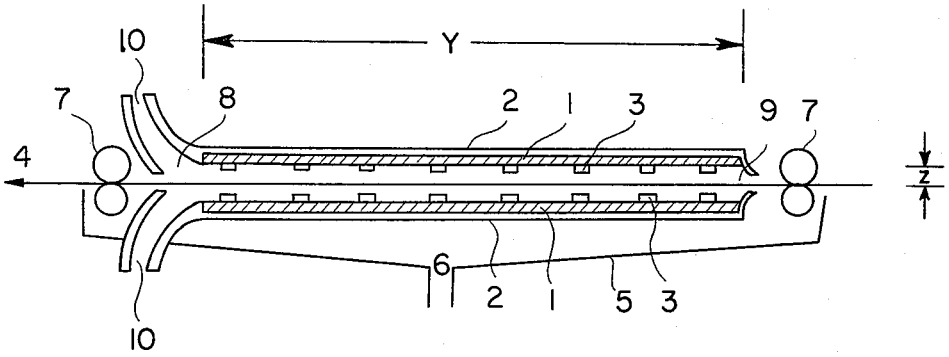
FIG. 2-A
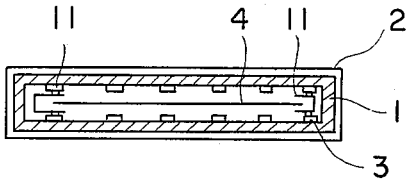
FIG. 2-B
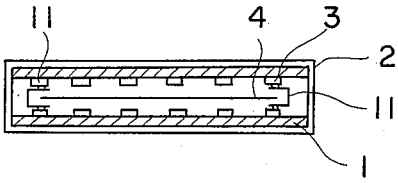
FIG. 2-C
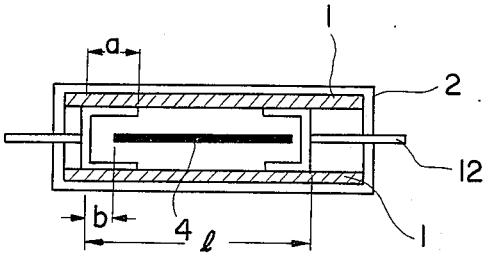

HORIZONTAL RECTILINEAR TYPE METAL-ELECTROPLATING METHOD

This is a continuation of application Ser. No. 310,079, filed Nov. 28, 1972, now abandoned.

BACKGROUND OF INVENTION

FIELD OF INVENTION

The present invention relates to a horizontal, rectilinear type electroplating method and an apparatus for carrying out the same.

Heretofore, a horizontal type plating method was known, by which, however, only one side of a metal strip was plated in an upper side open type plating vessel, and a horizontal plating apparatus for wire materials was also known. However, the known horizontal method and apparatus were confronted with the following serious disadvantages:

The first disadvantage resides in the fact that the replacement of electrode plates used as an anode, and particularly, replacement of a lower side plate, is difficult. Various materials may be selectively used as electrode plates which are used as an anode — i.e. a zinc anode for galvanization, a nickel anode for nickel plating and a copper anode for a copper plating. During the plating operation these metals are molten and remarkably consumed, which makes it necessary to periodically or semi-continuously replace the anodes. This is particularly true when the plating is being carried out with a large current, as is done in the high speed plating of strips. However, the replacement operation especially during the plating operation is very difficult, when carried out in a horizontal, rectilinear type plating apparatus, because the lower anode is located under the strip to be plated in the apparatus of this type. The upper anode replacement operation is not as difficult as in the case of the lower anode, but is still difficult, when using an upper cover.

A second disadvantage resides in that an anode sludge produced, as a by product of the consumption of the anode process, is deposited on the strip. This leads to defective plating and occurance of pin holes on the strip, whereby the quality of plated products is lowered.

A third disadvantage is that hydrogen gas, which is generated during the plating operation, is stagnated on the surface of the strip, particularly on the lower surface thereof, which leads also to defective plating and occurance of pin holes. Various attempts have heretofore been made to avoid these disadvantages, but no effective method has yet been discovered.

SUMMARY OF THE INVENTION

The object of the present invention is to provide a horizontal, rectilinear type plating method for plating metal strips, particularly steel strips, which avoids the abovementioned disadvantages, and a plating apparatus for carrying out such method.

The above object of the present invention is attained by employing a plating vessel lined with an insoluble anode material, which serves as an anode, and further, circulating a plating solution within the plating vessel to carry out the plating.

Therefore, the present invention relates to a horizontal, rectilinear type plating method for plating a horizontally traveling metal strip, particularly a steel strip comprising the steps of continuously running the strip through the interior of a plating vessel of a cylindrical form having a rectangle cross section, in which at least the interior top and bottom walls which face the upper and lower surfaces of the strip are lined with an insoluble anode material, which serves as an anode, and circulating a plating solution in counterflow within the plating vessel, and a method for regulating the plating solution.

Further, the present invention also relates to a horizontal, rectilinear type plating apparatus, comprised of a plating vessel of a cylindrical form having a rectangle cross section and having open ends, the vessel being lined with an insoluble anode material, which serves as an anode, at least at the interior top and bottom of the vessel opposite to the upper and lower sides of the horizontally passing metal strip and a receiver for receiving a treating solution from an inlet of the plating vessel and an apparatus for replenishing and regulating the plating solution.

BRIEF DESCRIPTION OF THE DRAWINGS

In the attached drawings,

FIG. 1 shows a side view of a first embodiment of the horizontal, rectilinear type plating apparatus of the present invention.

FIGS. 2A and B show a cross section of the front view of different embodiments of the apparatus shown in FIG. 1.

FIG. 2C shows a cross section of the front view of a device for shielding the electrodes of the present invention with movable electric insulators.

DESCRIPTION OF THE PREFERRED EMBODIMENT

Figure 3:
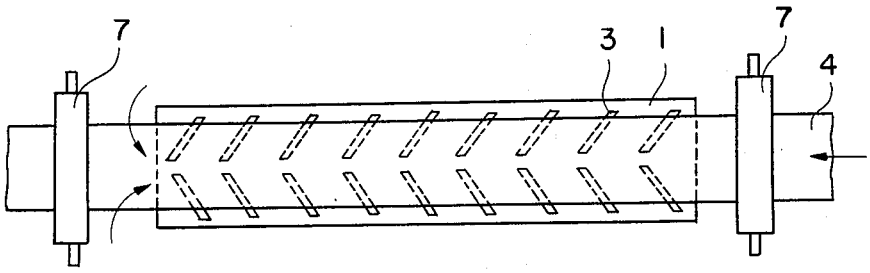
FIG. 3 is a plan view showing the interior of the plating apparatus shown in FIG. 1.

The apparatus of the present invention shall now be explained in detail with reference to the drawings. In FIG. 1 which shows a side view of one embodiment of the horizontal, rectilinear type plating apparatus a strip 4 to be plated is passed horizontally in a straight line through the interior of the plating apparatus and is plated, while being guided by conductor rolls 7. The plating apparatus is comprised of a box-type vessel made of an insoluble anode 1, and having a rectangle cross section. The vessel is covered by gum, synthetic resin or any other electric insulators 2 at its outer periphery as occasion demands or for the purpose of safety. Further, the surface of the anode 1 is provided with insulating interference plates 3 made of bakelite or the like so as to prevent the anode 1 and the strip 4 from being short-circuited, which can occur when the shape of the strip is bad or the strip is bent due to the tension strength thereof being reduced as a result of a line stop or the like. These interference plates 3 are so arranged, as shown in FIG. 3, and so designed that uniform flow of the plating solution in the plating vessel will be secured and no unevenness of plating may be caused in the width of the strip. Reference numeral 10 denotes an intake for introducing the plating solution. The plating solution is fed under pressure from a pump, introduced into the plating vessel through the intake 10, and flows in the direction counter to the running direction of the strip and then falls into a receiver 5 through an outlet 9 in the plating vessel. Some quantity of the plating solution unavoidably flows out from an outlet 8 of the plating vessel, which is, however, rather desirable from the view point of preventing air from entering the plating vessel, which may be induced by the stream of the plating solution. The plating solution collected in the receiver 5 is again introduced into the intake 10 by a pump through a vent 6 and a storage vessel.

FIGS. 2A, B and C show cross sections of various constructions of the plating vessel. FIG. 2A shows an embodiment wherein an insoluble anode is used as a material for constructing all four walls of the plating vessel. In such a case an electric current is often concentrated at the edge parts of the metal strip to be plated, whereby the phenomenon of so-called "edge overcoating" occurs, in which the edge parts are more thickly plated than the other parts of the strip. In order to prevent this overcoating it is desirable to provide edge overcoating preventing plates 11 made of an electric insulator, which prevent the electric current from concentrating at the edge parts. These plates are so arranged that their locations may be changed by hand or automatically changed by electro-motion according to changes in the width and the location of the metal strip to be plated and are provided at proper locations, such that no overcoating is caused.

FIG. 2B shows a cross section of another embodiment of the present invention, in which an insoluble anode is used as a material for constructing the upper and lower walls of the plating vessel.

FIG. 2C shows a device for movably shielding the electrodes of the present invention by an electric insulator which adapts to changes in the width as well as the location of the strip to be plated, in which 1 is an insoluble anode, installed at the upper and lower surfaces of the plating vessel. 4 is a strip, which is connected to a cathode and is plated while it passes between the upper and lower anodes. 12 is a movable shielding apparatus, which is an electric insulator and is made of a material having chemical resisting properties so as to be protected against the plating solution. This shielding device shields the anode 1 by a width (a), extending over the length of the plating vessel and is so arranged that it is movable in the direction of the width of the strip. This electric insulator has a ⊐⊢formed cross section, but is not limited thereto. It may be of the L-form or arc form, so long as an electric current shielding effect can be thereby obtained. Further, this electric insulator 12 is adapted to move and follow a change in the width of the strip 4 by means of an electric or mechanical means so that the exposed part of the anode is always less than the width of the strip by a difference of (a)-(b), amounting to 10–100 mm. That is, by covering over the edge part of the strip, which corresponds to the difference of (a)-(b), by the part (a) of the shielding plate, edge overcoating can be prevented. (b) is a distance sufficient to prevent the strip from coming into contact with the electric insulator even if a violent meandering of the strip occurs. This distance may be less than 50 mm., if the right and left hand sides of the electric insulator 12 are moved while being retained, a fixed distance ($l$) apart. By using the above-mentioned device it is possible to successfully cope with frequent changes in the width of the strip and thus prevent the overcoating of the edge of the strip by a simple operation.

As is evident from the above explanation, one of the main points of the present invention is the use of an insoluble anode which also forms the walls of the plating vessel. Various materials can be used as an insoluble anode such as carbon, insoluble lead alloy, metal of the platinum group and others. However, in view of mechanical strength and price the insoluble lead alloy is most suitable. The following advantages result from the use of his insoluble anode; no anode sludge is produced, the plating, producing no defects such as pin holes and the like, can be properly performed and such operation as the replacement of an anode is quite unnecessary. Moreover, as the anode itself is an integral part of the plating vessel in the present invention, there is nothing to obstruct the flow of the plating solution; thus a uniform stream of plating solution can be obtained and consequently very few uneven plated products are produced. In contrast, in a conventional plating apparatus the anode is often provided separately from the plating vessel and consequently the plating solution stream is obstructed and a uniform stream can not be obtained.

Further, in order to prevent "edge overcoating" it is desirable to provide edge overcoating preventing plates made of an electric insulating material to regulate the effective width of the anode according to the change in the width of the steel strip to be plated and to make the position of such preventing plates easily adjustable by shifting the same in response to a change in the width of the steel strip to be plated and the lateral movement of the steel strip. Consequently regulating the number of soluble anodes of rectangular form according to the width of the steel strip to be plated, as required when employing conventional soluble anodes, becomes unnecessary and a remarkable improvement of work efficiency is obtained.

The method of the present invention shall be explained in the following.

As above-mentioned, the conventional horizontal plating method is attended with defects such as defective plating or the formation of pin holes in plated products due in part to hydrogen gas generated from a cathode, which adheres to the surface of the cathode, particularly on the lower surface of the cathode of the metal strip to be plated. In order to avoid these defects the simplest method is to stir the plating solution. In the present invention, however, a different method is adopted, in which the plating solution is circulated in a counterflow against the running direction of the metal strip to be plated. Moreover, as there are no obstructions to the plating solution in the plating vessel of the present invention, because the interior of the plating vessel is also the anode itself, as above-mentioned, a uniform stream of the plating solution over the whole width of the metal strip is easily secured. Consequently the problem of pin holes being caused due to a non-uniform flow of plating solution is eliminated. Thus, metal strips uniformly and perfectly plated can be obtained.

However, in order to secure the above-mentioned effects the flow velocity of the plating solution must be $X \geqq 0.25\ y/z$ on the upper surface of the strip and $X \geqq 5y + 4$ on the lower surface of the strip, in which ($X$) is a flow velocity m./min., ($y$) is a length of electrode in m. and ($z$) is a distance between electrodes in m.

That is, a forced circulation of the plating solution with a flow velocity which satisfies both of the above conditions is a requisite condition for securing the above-mentioned effects.

For instance, if the length ($y$) of the electrode is 1.5 m. and the distance ($z$) between electrodes being 0.03 m., the flow velocity of the plating solution must be $$X \geqq 0.25 \times \frac{1.5}{0.03} = 12.5 \text{ m./min.}$$

on the upper surface of the strip and $X \geqq 5 \times 1.5 + 4 = 11.5$ m./min. on the lower surface of the strip.

If the flow velocity is below these values, oxygen gas generated from the upper and lower anodes and hydrogen gas generated from the cathode stagnate on a part of the surface or the whole surface of the strip, whereby the electric current is obstructed.

Therefore, in carrying out the plating of a metal strip by using a zinc sulfate plating bath, the object of the present invention can be attained by circulating the plating solution in a counterflow against the running direction of the strip to be plated with a flow velocity which satisfies the above two conditions.

Further, it should be noted that the current density used for plating depends largely upon the line speed of the strip. That is, the greater the speed of the strip, the larger the current density which can be employed for plating. When circulating the plating solution in the direction counter to the running direction of the strip, as in the present invention, the relative flow velocity between the strip and the plating solution becomes substantially greater than the line speed of the strip, which makes it possible to carry out the plating with a greater current density than when the plating solution is not circulated, and consequently a further speed-up of the plating process can be effected.

On the other hand, in order to obtain a highly anticorrosive strip plated at a high speed by using the insoluble anode, it is necessary to maintain a constant metal ion concentration. But, hitherto the zinc sulfate plating bath was utilized only in situations where the area of the electro deposition was relatively small, as compared with the capacity of the plating vessel, such as for plating wires where the consumption of metal ions per hour is small and the fluctuation in the metal ion concentration is minimal. However, if a high speed electroplating of a steel strip should be carried out by using the insoluble anode, a large amount of metal ions will be consumed. Therefore, in order to keep the ion concentration constant, the plating vessel must become very large and the sampling frequency must be increased, which lead to a large increase in construction costs and personnel expenses. If such precautions are not taken, however, in order to maintain the costs at a lower level by, for instance allowing the ion concentration to stray out of the required control range, a so-called "burning deposit" would be caused which would depreciate the commercial value of products produced. Therefore, there has hitherto never been adopted a method of continuously plating steel strips in a plating vessel by using an insoluble anode.

In efforts of solving these problems as above-mentioned the present invention has succeeded in developing a method for continuously applying an excellent high speed zinc plating on the surface of a steel strip in a plating vessel provided with an insoluble anode at very low construction costs and personnel expenses by automatically controlling the concentrations of zinc ions and sulfuric acid radical ions contained in the plating bath by the combined use of a gravimeter and a pH-meter. That is, by the combined use of the gravimeter and pH-meter the zinc ion concentration and the pH value of the plating bath are detected, and if their detected values deviate from the set values, an automatic control is performed so that the detected values are adjusted to fall within the range of the optimal set values. Further, for the purpose of regulating the zinc ion concentration and the pH value within the ranges of the optimal set values a method such as melting a metallic zinc of low grade, particularly by a plating solution, and regulating the specific gravity value and pH value of the circulating solution by using the solution, in which the metallic zinc is dissolved, is used. The apparatus for regulating the zinc plating, as above-mentioned, may comprise a liquid level gauge for keeping the surface of the plating solution constant, a water feed pipe provided with water-feed valves which are opened and closed by signals from the liquid level gauge, a pipe system for replenishing zinc sulfate solution and having valves which are opened and closed by signals from the gravimeter and the pH-meter for automatically controlling the zinc concentration and the pH value of the plating bath within the range of the optimal set values, a pump for feeding zinc sulfate, the pump being operated by the signals from the gravimeter and the pH-meter, and a tank for dissolving zinc. pH-meter for automatically controlling the zinc concentration and the pH Further, the present invention shall be explained in more detail with reference to the attached drawings.

Figure 4:
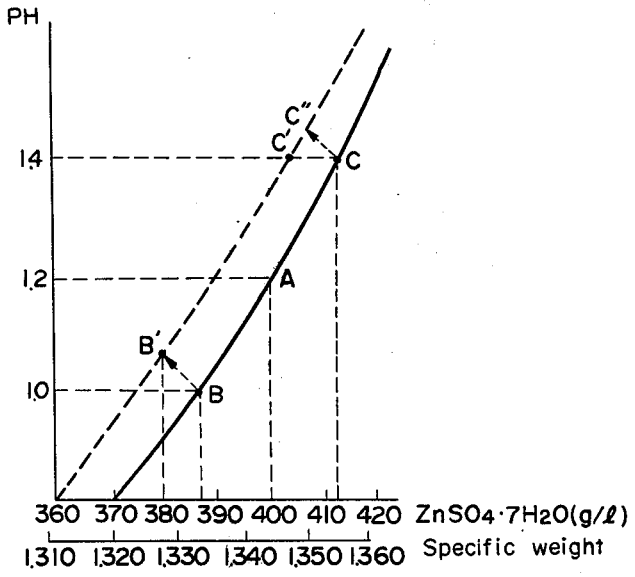
FIG. 4 is a curve tracing the relationship between the amount of zinc sulfate contained in a plating bath and its specific weight and a pH value of the plating bath.
Figure 5:
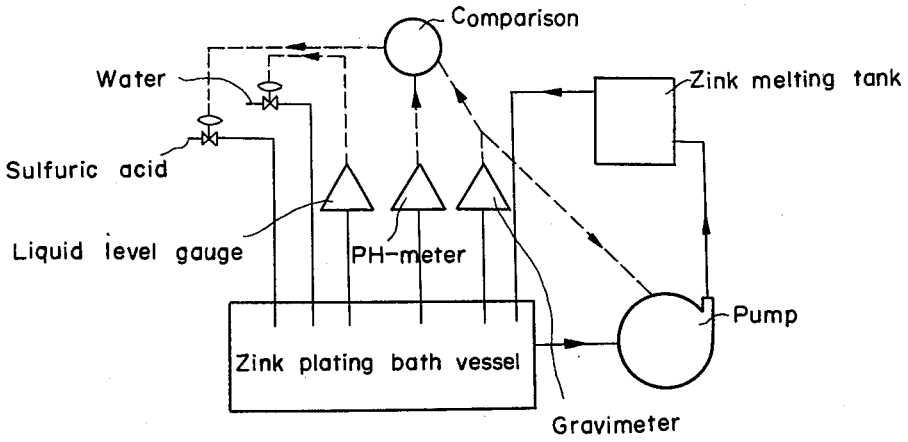
FIG. 5 is an explanatory view schematically showing an apparatus for carrying out the regulation of the plating bath of the present invention.

FIG. 4 shows curves obtained by experimentally tracing the relationship between the pH value of the plating bath and an amount (g./l.) of $ZnSO_4.7H_2O$ contained in the plating bath and the specific weight of the bath, and FIG. 5 is an explanatory view schematically showing the apparatus for carrying out the method of the present invention.

The actual method of the present invention using the apparatus shown in FIG. 5 shall be explained on the basis of the curves shown in FIG. 4, while taking a simple zinc sulfate bath as an example.

In the case of galvanizing a moving steel strip in a simple zinc sulfate plating bath at a high speed, using an insoluble anode, the control range of the zinc sulfate concentration in the plating bath is assumed to be 400 $\pm$ 20 g./l. and that of the pH value of the plating bath to be 1.2 $\pm$ 0.2. If starting a plating operation under the conditions at point A shown in FIG. 4, the zinc sulfate concentration and the pH value decline along the curve CAB. When coming down to the point B, the pH value reaches the lower limit of its control range, amounting to 1.0, while the zinc sulfate concentration shows a value of about 387 g./l., which is still within the control range. As the zinc sulfate concentration can be measured by measuring the specific weight value, as shown in FIG. 4, the pump is actuated on comparison of the signals from the gravimeter and the pH-meter shown in FIG. 5, whereby the plating solution is introduced into a zincmelting tank, and the plating solution containing a molten zinc is fed back into a zinc plating bath vessel. Consequently, the pH value and the zinc sulfate concentration rise along the curve CAB in FIG. 4. At point C, the pH value reaches 1.4, which is the upper limit of the control range, whereas the zinc sulfate concentration lies still within the control range, showing about 412 g./l. According to the arrangement shown in FIG. 5 the operation of the pump is stopped by comparison of the signals from the pH-meter and the gravimeter. The pH value and the zinc sulfate concentration begin to again decline along the curve CAB. Theoretically there is an endless repetition of the up-and-down movement within the control range. However practically speaking some amount of the plating solution is withdrawn along with the steel strip on one hand and some water is carried in by the steel strip from a previous washing step on the other hand. The liquid level gauge in FIG. 5 is provided to keep the liquid level in the zinc plating bath vessel always constant. If the bath level falls below the prescribed level, the valve of the water feed pipe is opened to feed water. Suppose that the valve of the water feed pipe at the point B is now opened and water is being fed. Then, the pH value rises and the zinc sulfate concentration falls. At the point of time when the replenishment of water is ended, the plating bath becomes the composition shown at the point B'. Namely, the pH value is about 1.05, which is within the control range and the zinc sulfate concentration is approximately 380 g./l., which corresponds to the lower limit of the controlled range. Then, the pump is again actuated on comparison of the signals from the pH-meter and the gravimeter shown in FIG. 5, whereby the pH value and the zinc sulfate concentration rise along the curve B'C'. When the point C' is reached, which corresponds to the upper limit of the control range of the pH value, the pump is stopped. Suppose now that the valve of the water feed pipe is opened at the point C. Then, the pH value rises and the zinc sulfate concentration falls. At the point of time when the replenishment of water is ended, the composition of the plating bath becomes that as shown by the point C''. As the pH value at the point C'' of about 1.45 is higher than the upper limit of the control range of the pH value, the sulfuric acid value is opened to replenish sulfuric acid until the pH value reaches 1.4.

As is above-mentioned, by the combined use of the pH-meter and the gravimeter in the present invention automatic control of the pH value and the zinc sulfate concentration can be performed certainly and exactly so as to keep the pH value within the control range of $1.2 \pm 0.2$ and the zinc sulfate concentration within the control range of $400 \pm 20$ g./l.

Further, another way of replenishing a zinc plating solution shall be explained as an embodiment of the present invention. That is, as regards the replenishment of zinc metal substance, for instance, low grade metallic zinc ingots may be used for the purpose of reducing plating cost. As is well known, when zinc plating by hot dipping is carried out so-called "dross", which is a product of the reaction of a molten metal bath with air and iron is produced. This dross contains zinc, iron, lead, aluminum and others. As this dross is not suited for hot dipping, it is removed from the plating system and is counted as a loss in the yield of metallic zinc. A further advantage of the present invention is that this dross can effectively be utilized as a low grade zinc resource. This dross contains iron, aluminum and lead in an amount of 1 to 8% and has a very high solubility in an acidic zinc electro-plating bath as compared with high purity zinc. Moreover, for the method based on a chemical melting of metal the use of a low-grade metal is particularly advantageous in view of this high melting rate. Therefore, by combining the use of this dross with the method and apparatus of the present invention a more notable effect can be obtained.

What is claimed is:

1. A method for plating a steel strip, said method comprising:

providing a plating vessel having a rectangular cross-section, a strip inlet, a strip outlet and an interior having opposed horizontal and parallel upper and lower walls formed of an insoluble anode material;

providing interference plates formed of an insulating material on each said upper and lower walls in an arrangement such that all of said plates extend obliquely in a direction inwardly from lateral edges of said walls and from said strip inlet toward said strip outlet;

continuously passing a horizontally aligned steel strip, as a cathode, in a horizontal and rectilinear direction through said strip inlet, through said vessel interior between said upper and lower walls, and outwardly through said strip outlet;

continuously circulating substantially all of a plating solution within said plating vessel entirely in a direction counter to the direction of movement of said steel strip, while maintaining the flow velocity of said plating solution such that $X \geqq 0.25\ y/z$ on the upper surface of said steel strip and $X \geqq 5y + 4$ on the lower surface of said steel strip, wherein $X$ is flow velocity of said plating solution in m/min., $y$ is the length of said walls of anode material in m, and $z$ is the distance between either of said walls of anode material and said strip in m;

said step of continuously circulating said plating solution comprising passing said plating solution at least partially between longitudinally adjacent of said interference plates in oblique directions and thereby flowing said plating solution uniformly across the entire width of said strip; and operating said walls of insoluble anode material as anodes and thereby plating both surfaces of said strip as it passes through said vessel.

2. A method as claimed in claim 1, wherein said plating surface is a zinc sulfate solution; and further comprising automatically detecting zinc concentration and pH of said plating solution by the combined use of a gravimeter and pH meter; and automatically maintaining said zinc concentration and pH of said plating solution within predetermined ranges.

3. A method as claimed in claim 2, wherein said step of maintaining comprises automatically controlling the specific gravity and pH of said plating solution by automatically adding thereto dissolved low grade metallic zinc when the values detected by said gravimeter and pH meter are without said predetermined ranges.

* * * * *